US005251093A

United States Patent [19]

Dickey

[11] Patent Number: 5,251,093

[45] Date of Patent: Oct. 5, 1993

[54] SIMPLIFIED SELF-LATCHING RELAY SWITCHING CIRCUIT

[75] Inventor: John A. Dickey, Palm Bay, Fla.

[73] Assignee: SpaTron Corporation

[21] Appl. No.: 705,373

[22] Filed: May 24, 1991

[51] Int. Cl.[5] ..... H01H 47/32

[52] U.S. Cl. ..... 361/160; 361/187

[58] Field of Search ..... 361/152, 153, 160, 170, 361/186, 189, 190, 194, 205, 198, 187; 307/112, 140, 142, 143, 598

[56] References Cited

U.S. PATENT DOCUMENTS

| | | | |
|---|---|---|---|
| 3,089,985 | 5/1963 | Camfield et al. | 361/189 |
| 3,193,733 | 7/1965 | Orsino | 361/153 |
| 3,629,608 | 12/1971 | Trindle | 307/140 |
| 4,031,435 | 6/1977 | Zioni et al. | 361/186 |
| 4,420,787 | 12/1983 | Tibbits et al. | 361/79 |
| 4,468,715 | 8/1984 | Reno, Jr. | 361/186 |
| 4,603,370 | 7/1986 | Imazeki et al. | 361/155 |
| 4,724,504 | 2/1988 | Prouty | 361/165 |
| 4,841,404 | 6/1989 | Marshall et al. | 361/30 |

*Primary Examiner*—A. D. Pellinen
*Assistant Examiner*—Aditya Krishnan
*Attorney, Agent, or Firm*—Charles E. Wands

[57] ABSTRACT

A simplified self-latching relay switching circuit includes a switch, a power shunt circuit including a power node and a shunting device for shunting power from the node to ground, a relay for latching power into the circuit, and a passive circuit which operates the shunting device. When the switch is activated a first time, power is applied to the power shunt circuit, and the node voltage rises according to an RC time constant. The passive circuit is clamped to the node, so a voltage in the passive circuit is prevented from rising rapidly. When the node voltage reaches a threshold value, the relay is activated, latching power into the power shunt circuit. If the switch is then activated a second time, the clamp no longer restrains the passive circuit voltage from rising rapidly. The rapid rise of the passive circuit voltage activates the shunting device, which deactivates the relay to unlatch power to the power shunt circuit, and shunts the node voltage to ground.

14 Claims, 2 Drawing Sheets

SIMPLIFIED SELF-LATCHING RELAY SWITCHING CIRCUIT

FIELD OF THE INVENTION

This invention in general pertains to the control or switching of relays, and pertains specifically to a relay switching circuit that self-latches or holds the relay on after it picks up and closes. The invention also provides a method for the same switch or another control signal to de-energize the relay and associated circuitry

BACKGROUND OF THE INVENTION

In simple control products where a relay simply must be closed and opened and possibly have a time-out or other additional simple functions, there are many circuit configurations that can be used. Generally, each configuration includes a power supply, the relay, the control switch, a logic section to coordinate the switch with any time-out or other function, and a driver for the relay. For cost effective manufacturing, each of these functional areas over the years have been reworked many times to reduce the number of components for each section but generally speaking all of these functional sections can be identified independently in most design configurations.

Component count and cost may be further reduced by eliminating entire functional sections or combining them. Both of these approaches have been used in the current invention.

SUMMARY OF THE INVENTION

In accordance with the present invention there exists a new circuit which provides for a substantial reduction in component count and cost to accomplish the functionality of self-latching relay switching with time-out or other optional controls.

Noteworthy factors in this configuration are the elimination of the normal relay driver and the reduction of the normal control logic to the simple passive network. Thus, a circuit in accordance with the invention achieves advantageous small size and ease, and low cost of manufacturing

BRIEF DESCRIPTION OF THE DRAWINGS

The present invention may be better understood and the further advantages and uses more apparent when considered in view of the Description of the Preferred Embodiments below and the following figures in which.

DESCRIPTION OF THE PREFERRED EMBODIMENTS

Figure 1:
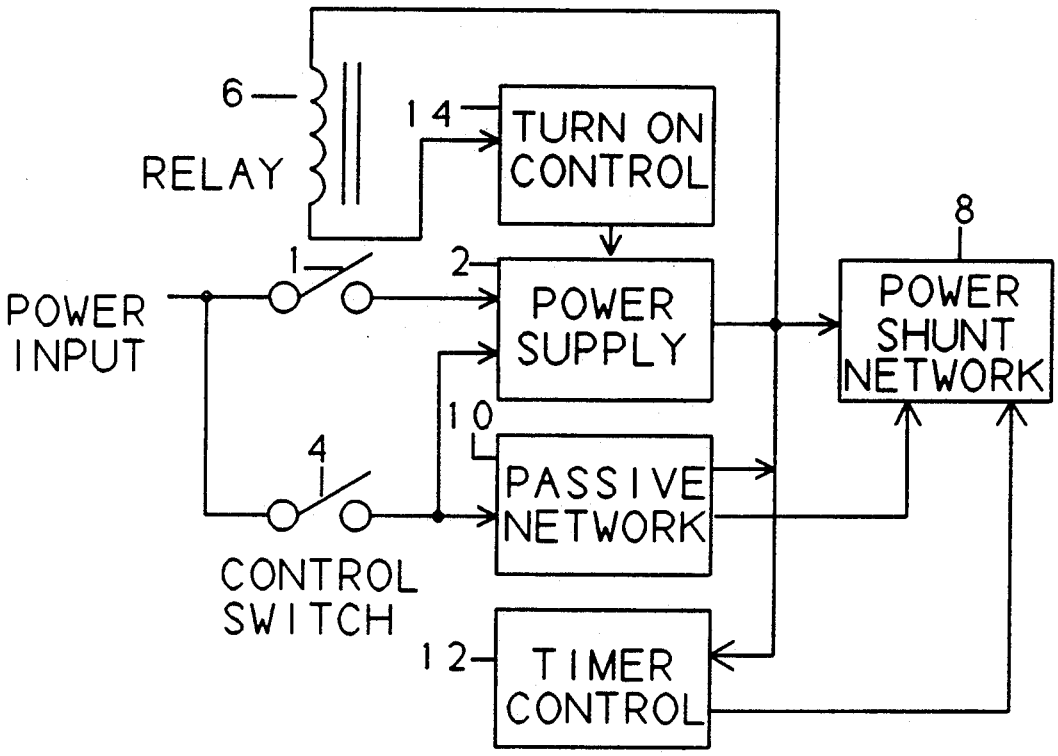
FIG. 1 shows a block diagram of the circuit system constructed in accordance with the teachings of the present invention.

The basic functionality of the circuit can be seen from the block diagram in FIG. 1. A power supply 2 is simply a series impedance and a rectifier into a filter capacitor. When a control switch 4 first closes, it brings up the power supply 2. A relay 6 closes and holds the power supply 2 on until a first network shown as a power shunt network 8 is activated. A second network shown as a passive network 10 only activates the power shunt network 8 when the control switch 4 is pushed if the power supply 2 is already up and stable, thereby not turning the system off during a power up sequence. A timer control system 12 or other optional turn-off subsystem can activate the power shunt network 8 any time after the power is up and stabilized. When the power shunt network 8 is activated, the power supply voltage drops below the value required to keep the relay closed. The relay 6 then drops out and the entire system is turned off.

Figure 2:
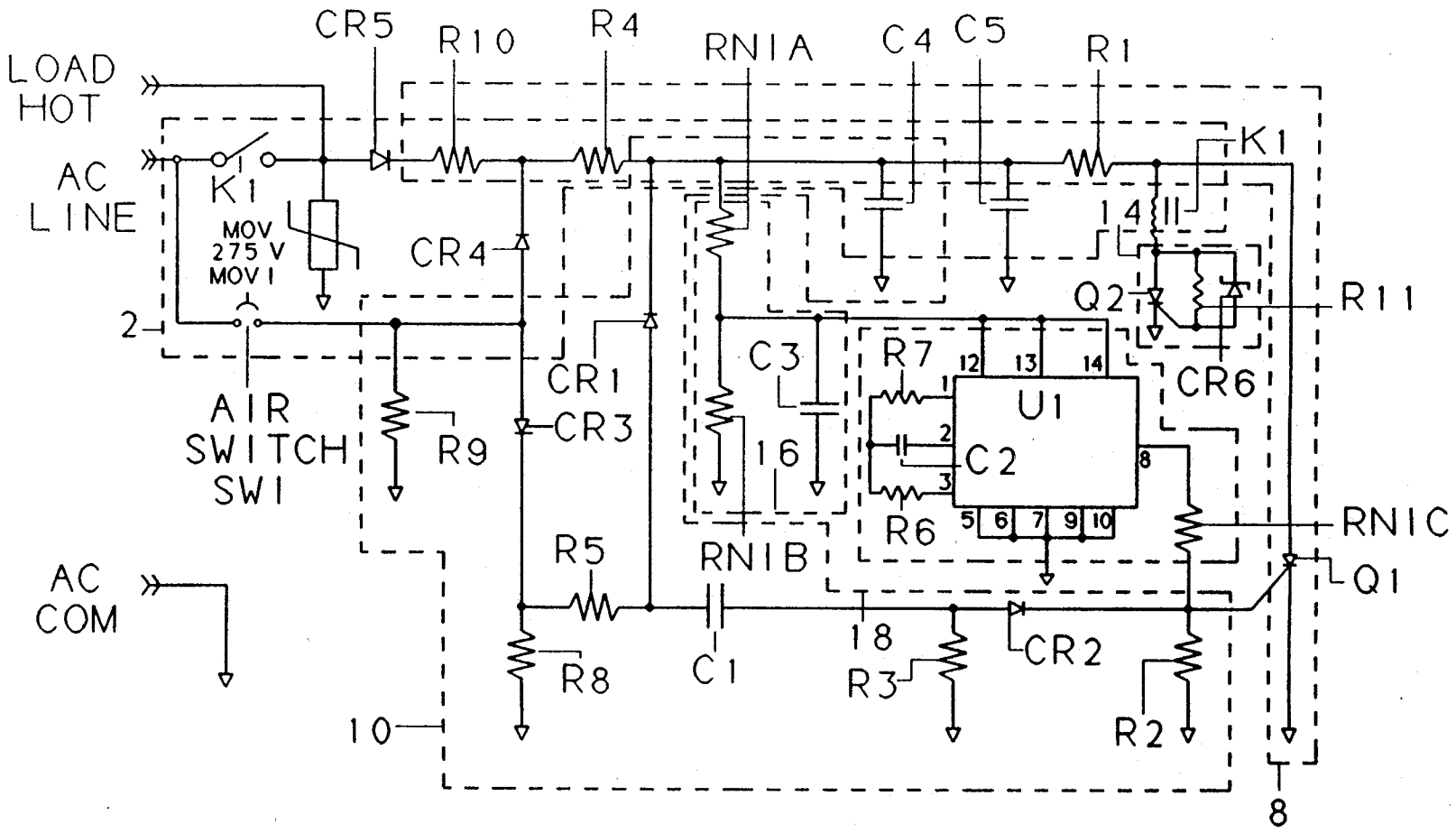
FIG. 2 shows the circuitry of the preferred embodiment with the optional logic shown as a time-out function.

FIG. 2 is a detailed schematic diagram of the preferred embodiment of the present invention. Since many individual components provide functions for more than one functional block in FIG. 1, it is best to evaluate the components contributions to each block as the block is discussed as opposed to describing the system on a component by component basis.

The Power Input is shown in FIG. 2 as AC LINE and AC COM inputs on the left side of FIG. 2. The AC COM input has not been shown on the block diagram in FIG. 1, and other lines have been left out of FIG. 1 for simplicity.

The basic Power Supply 2 shown in FIG. 1 includes a number of components from FIG. 2. The AC LINE enters through either a relay K1 in conjunction with a rectifier CR5 and a resistor R10 or through an Air Switch SW1 and a rectifier CR4. The current then flows through a resistor R4, a resistor R1, a relay coil K1, and an SCR Q2 back to the AC Com terminal. This provides half wave rectified current through the voltage divider network formed the by resistors R4, R1 and the resistance of the relay coil K1. The selection of the value of R4 in conjunction with the resistance of the relay coil provides for the proper voltage drop for the operation of the relay. The resistance of the SCR Q2 is negligible and the resistance of the resistor R1 is also small but is required for the Power Shunt Network 8 described later. A capacitor C4 provides basic filtering for the main power supply voltage. A supplementary supply voltage is optionally created at a secondary power node by a resistive divider network of resistors RN1A coupled to a primary power node in the network 2 and RN1B coupled to AC Com along with additional filtering provided by a capacitor C3. These components are collectively shown as 16. This supplementary supply is well known to those skilled in the art.

A Turn-on Control circuit 14 shown in FIG. 1 includes the SCR Q2, a resistor R11 and a Zener diode CR6 as shown in FIG. 2. This circuit 14 provides one of the novel functions for the success of this circuit. It functions by turning the SCR Q2 on only after the main power supply voltage has charged up to the minimum voltage required for the relay to pull in rapidly according to its specification, thereby protecting the contacts of the relay from excessive heating and arcing that would be associated with a design that allowed the relay to pull in gradually as the main power supply voltage gradually charged up. This was needed since a normal relay driver switch is not used in this design.

The Power Shunt Network 8 shown in FIG. 1 includes the resistors R10, R4 and R1 and a power shunting device shown as an SCR Q1 as shown in the circuit diagram in FIG. 2. The operation of this circuit begins when either the Passive Network 10 or the Timer Control 12 or other optional logic signal fires the SCR Q1. Once SCR Q1 has been fired it shunts the power supply from the relay coil K1 to ground. During this time that the relay power is shunted to ground, the resistors R10 and R4 limit the amount of power supply current that can be drawn from the power line so that the total power dissipation in all the components is limited to a safe operating level. The resistor R1 and the capacitor C4 provide a time constant for a controlled release of charge stored in the capacitor C4 through the resistor R1 and through the SCR Q1 during the half of the power line cycle when no power is entering the system from the power line. This maintains the minimum conduction current through the SCR Q1 that is required for it to stay in the ON or conducting state. With this arrangement, once the SCR Q1 has been fired, it will continue to stay on until the relay K1 has opened and no more power is available to maintain a charge on the capacitor C4. When the charge on the capacitor C4 has been depleted to the point that the SCR Q1 will turn off, then there is not nearly enough voltage to turn the relay back on, thereby leaving the entire system unpowered and in the 'OFF' state.

The resistor R10 works in conjunction with the resistor R4 to limit power supply current during normal operations that have been described above, but is bypassed during turn-on by the air switch SW1 to provide a voltage boost to the relay during the time when the relay is first making connection and the line voltage may by lowered by the heavy current drain from the load, as would be the case in starting a motor, for example.

The Passive Network 10 shown in FIG. 1 includes a number of parts in the circuit diagram shown in FIG. 2 including resistors R2, R3, R5, R8, R9, RN1C, capacitors C1 and C4 and rectifiers CR1, CR2, and CR3. During system turn-on, the air switch SW1 is first closed. Then current flows from the AC Line through both rectifiers CR3 and CR4 as well as through the resistor R9. Rectified power through the rectifier CR4 provides power to the main power supply, and rectified power through rectifier CR3 provides a half wave rectified line voltage signal for further processing by the other components. The resistor R9 provides a path to ground for reverse leakage currents from the rectifier CR4 after the air switch SW1 is opened and the system is ON. The resistor R8 provides a discharge path for charge stored on the capacitor C1 during times when no voltage is coming from the air switch SW1 through the rectifier CR3. The resistor R5 provides current limiting for power through the rectifier CR3 and works in conjunction with the capacitors C1 and C4 to provide charge and discharge time constants.

As the system power supply comes up, the voltage at the junction of the resistor R5 and the capacitor C1 is limited by the conduction of the rectifier CR1 which acts as a clamping device or, more specifically, a clamping diode. In conjunction with the current limiting action of the resistor R5, the rectifier CR1 limits the rate of rise of the voltage at the junction of the resistor R5 and the capacitor C1 to the rate of rise of the main power supply voltage itself. The main power supply voltage rate of rise itself is limited by the charging time constant of C4 in conjunction with R10, R4, R1, and the relay coil K1. During the half cycles when no current is applied through the rectifier CR3, the resistors R5 and R8 act in series to limit the discharge current from the capacitor C1 to a very low, value and a correspondingly long time constant. As long as the air switch SW1 is held closed, the voltage on the capacitor C1 will approximate that of the main power supply voltage. Once the air switch SW1 is opened, the long time constant of the resistors R5 and R8 in conjunction with the capacitor C1 will slowly discharge the capacitor C1 back to zero volts as measured between the junction of the resistor R5 and capacitor C1 and the AC Com.

The portion of the Passive Network Block 10 described above has controlled the voltage rate of change at the junction of the resistor R5 and the capacitor C1. Further processing is accomplished by the operation of the capacitor C1 and the resistor R3 acting together as a differentiator circuit. The voltage then seen at the junction of the capacitor C1 and the resistor R3 is approximately proportional to the rate of change of voltage at junction of the resistor R5 and the capacitor C1.

Again, further processing is accomplished by the rectifier CR2 and the resistor R2. The nonlinear current voltage relationship for the rectifier CR2 is used in conjunction with the resistor R2 to form a non-linear voltage divider. In this way, voltages below about 0.7 volts at the junction of the resistor R3 and the rectifier CR2 do not contribute any current to form a voltage drop across the resistor R2. This provides a level of noise immunity to the system to avoid false triggering of the SCR Q1, as well as eliminating the small ripple signal that gets through the capacitor C1 due to the small charge and discharge of the capacitor C1 between the positive and negative half AC Lin voltage contributions. The resistor R2 also provides a ground path for leakage current from the gate of the SCR Q1 to again avoid false triggering.

During the turn-on of the system, the Passive Network 10 limits the rate of charging of the capacitor C1 so that no signal is supplied to the SCR Q1 and SCR Q1 then stays OFF.

A main purpose of the Passive Network 10 is to provide a system for the Air Switch SW1 to be able to turn the system off as well as turn the system on.

The turnoff of the system is accomplished as follows: The system is on and enough time as passed for the combination of the resistors R5 and R8 to discharge the capacitor C1. When the air switch SW1 is closed, the voltage at the junction of the resistor R5 and the capacitor Cl begins to rise almost as fast as the line voltage, limited only by the drop through the resistor R5 due to the small current drawn to charge the capacitor C1 as it charges. This is in contrast to when the system was being turned on because now the main power supply capacitor C4 is fully charged and the rectifier CR1 no longer acts as a clamping diode. With this arrangement, the rate of rise of voltage at the junction of the resistor R5 and the capacitor C1 may be 100 times the rate of rise during turnon when the rectifier CR1 was clamping that voltage. Because of the much higher rate of rise of voltage at the junction of the resistor R5 and the capacitor C1, the differentiator circuit formed by the capacitor C1 and the resistor R3 provides a much higher signal to the input of the rectifier CR2 and forces it to conduct enough current to provide an adequate voltage drop across the resistor R2 to force the SCR Q1 into conduction. Once the conduction of the SCR Q1 has been initiated, the system is assured to shut down following the sequence described above for the Power Shunt Network 8.

Optional logic circuitry generally shown as 18, which may include a simple timeout system U1 as shown in the block diagram in FIG. 1 and the circuit diagram in FIG. 2, a no-load sense circuit, etc., can then be tied into the system by tapping power from the main power supply as described above and connecting into the gate of the SCR Q1 through a resistor such as the resistor RN1C. This resistor limits the current through the gate of the SCR Q1 when the optional circuit signals for system turnoff, and also provides a reverse impedance path so that the signal from the rectifier CR2 is not drained away from the gate of the SCR Q1 when the switch SW7 is used for manual system turnoff.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed is:

1. A self-latching relay circuit for providing power to a load comprising:

a power supply node to which a source of power for said load is supplied;

an output node from which power is applied to said load;

a relay having a relay coil coupled in circuit between said output node and a reference potential terminal, and a normally open relay contact coupled between said power supply node and said output node, said relay contact, in its normally open state, preventing power that is supplied to said power supply node from being coupled to said output node and, therefrom, to components of said relay circuit including said relay coil, said relay contact being closed by the energization of said relay coil, such that power may be supplied from said power supply node through the closed relay contact to said output node, for application to said load and to said relay coil, so as to hold said relay in a self-latched state; and a relay operation control circuit, coupled in circuit with said power supply node and said relay coil, said relay operation control circuit, for the case of a first, normally open state of said relay contact, also preventing power that is supplied to said power supply node from being coupled to said output node and therefrom to components of said relay circuit including said relay coil, so that said relay circuit draws no current during its off state, said relay operation control circuit being controllably operative to supply power from said power supply node to said relay coil, thereby energizing said relay coil and causing said normally open relay contact to close and place said relay in said self-latched state.

2. A self-latching relay circuit according to claim 1, wherein said relay operation control circuit further includes a controlled shunt circuit, coupled in circuit with said relay coil and said reference potential terminal, and being operative, for the case of a second, closed state of said relay contact, for controllably shunting power away from said relay coil, so as to deenergize said relay coil, thereby causing said closed relay contact to open, interrupting the supply of power from said power supply node to said output node, whereby said relay is no longer held in a self-latched state.

3. A self-latching relay circuit according to claim 2, wherein said relay operation control circuit includes a normally open switch, coupled in circuit with said power supply node and said relay coil, said switch, in its normally open condition, preventing power that is supplied to said power supply node from being coupled to components of said relay circuit including said relay coil, the closure of said normally open switch, during the deenergized state of said relay coil with said relay contact open, providing a current flow path from said power supply node to said relay coil and causing power to be supplied from said power supply node to said relay coil, so that said relay coil is energized, thereby closing said normally open relay contact and placing said relay in said self-latched state.

4. A self-latching relay circuit according to claim 3, wherein said controlled shunt circuit is responsive to the closure of said normally open switch during the self-latched state of said relay, to effectively shunt power away from said relay coil, so as to deenergize said relay coil, thereby causing said closed relay contact to open, interrupting the supply of power from said power supply node to said output node, whereby said relay is no longer held in a self-latched state.

5. A self-latching relay circuit according to claim 4, wherein said relay operation control circuit includes a voltage limiting circuit coupled in circuit with said normally open switch, said relay coil and said controlled shunt circuit, said voltage limiting circuit being operative, in response to the closure of said normally open switch during the deenergized state of said relay, to limit voltage applied to said controlled shunt circuit to a value that prevents said controlled shunt circuit from being turned on, and being operative, in response to the closure of said normally open switch during the energized state of said relay, to permit voltage applied to said controlled shunt circuit to reach a value that causes said controlled shunt circuit to be turned on and thereby effectively shunts power away from said relay coil, so as to deenergize said relay coil, thereby causing said closed relay contact to open, interrupting the supply of power from said power supply node to said output node, whereby said relay is no longer held in a self-latched state.

6. A self-latching relay circuit according to claim 5, wherein said relay operation control circuit includes a voltage dropping network coupled in circuit between said power supply node and said relay coil, said voltage dropping network being operative to limit the voltage applied across said relay coil during the self-latched state of said relay.

7. A self-latching relay circuit according to claim 3, wherein said relay operation control circuit further includes a energy storage circuit coupled in circuit with a first current flow path through said controlled shunt circuit, said controlled shunt circuit providing an energy discharge path for said energy storage circuit, and wherein said relay operation control circuit further includes a capacitor filter circuit coupled in circuit with a second current flow path from said switch to said controlled shunt circuit to control the operation thereof, and wherein said relay operation control circuit is operative to cause said energy storage circuit to store electrical energy supplied by said power supply through said relay contact in response to the closure of said normally open switch during the deenergized state of said relay coil, and wherein said capacitor filter circuit is operative to prevent the turn-on of said controlled shunt circuit by the closure of said switch after the storage of electrical energy by said energy storage circuit.

8. A self-latching relay circuit according to claim 7, wherein said relay operation control circuit is operative to prevent the turn-off of said controlled shunt circuit by the closure of said switch until electrical energy stored by said energy storage circuit has been discharged through said controlled shunt circuit.

9. A self-latching relay circuit according to claim 2, wherein said relay operation control circuit further includes a energy storage circuit coupled in circuit with a first current flow path through said controlled shunt circuit, said controlled shunt circuit providing an energy discharge path for said energy storage circuit, and wherein said relay operation control circuit further includes a filter circuit coupled in circuit with a second current flow path to said controlled shunt circuit to control the operation thereof, and wherein said relay operation control circuit is operative to cause said energy storage circuit to store electrical energy supplied by said power supply through said relay contact, and wherein said filter circuit is operative to prevent the turn-on of said controlled shunt circuit until after the storage of electrical energy by said energy storage circuit.

10. A self-latching relay circuit according to claim 7, wherein said relay operation control circuit is operative to prevent the turn-off of said controlled shunt circuit until electrical energy stored by said energy storage has been discharged through said controlled shunt circuit.

11. A self-latching relay circuit according to claim 1, wherein said relay operation control circuit includes a controlled switching device, coupled in a circuit path with said output node, said relay coil and said reference potential terminal, and being operative to prevent current flow through said relay coil until the voltage magnitude thereacross is sufficient to immediately close said relay contact.

12. A self-latching relay circuit according to claim 11, wherein said relay operation control circuit includes a normally open switch, coupled in circuit with said power supply node and said relay coil, the closure of said normally open switch, during the deenergized state of said relay coil with said relay contact open, provides a current flow path from said power supply node to said relay coil and causes power to be supplied from said power supply node to said relay coil, whereby said relay coil is energized in response to said controlled switching device being turned on upon the voltage applied to said relay coil reaching said sufficient magnitude.

13. A self-latching relay circuit according to claim 1, further including a timeout-based relay deenergized circuit, responsive to the expiration of a prescribed period of time subsequent to the energization of said relay coil, for preventing power at said output node from being applied to said relay coil, so as to deenergize said relay coil, thereby causing said closed relay contact to open, interrupting the supply of power from said power supply node to said output node, whereby said relay is no longer held in a self-latched state.

14. A self-latching relay circuit according to claim 13, wherein said a relay deenergizing circuit includes a controlled shunt circuit, coupled in circuit with said relay coil and said reference potential terminal, and being responsive to the expiration of said prescribed period of time subsequent to the energization of said relay coil, for effectively shunting power away from said relay coil, so as to deenergize said relay coil, thereby causing said closed relay contact to open, interrupting the supply of power from said power supply node to said output node, whereby said relay is no longer held in a self-latched state.

* * * * *